United States Patent [19]

Newman

[11] 3,965,638

[45] June 29, 1976

[54] INSULATED GLASS PANEL

[75] Inventor: Irvin Newman, Cherry Hill, N.J.

[73] Assignee: Ira W. Fine, Pennsauken, N.J.

[22] Filed: July 2, 1974

[21] Appl. No.: 485,165

[52] U.S. Cl. ..... 52/616; 49/501; 52/628

[51] Int. Cl.[2] ..... E04C 2/34

[58] Field of Search ..... 52/616, 621, 627, 628, 52/202, 658; 49/501, DIG. 1, 498, 475

[56] References Cited

UNITED STATES PATENTS

| | | | |
|---|---|---|---|
| 3,261,139 | 7/1966 | Bond | 52/616 |
| 3,303,626 | 2/1967 | Brigham | 52/627 X |
| 3,334,464 | 8/1967 | Charles | 49/501 X |
| 3,360,893 | 1/1968 | Wattelez | 52/202 X |
| 3,411,247 | 11/1968 | Fleming | 52/616 X |
| 3,427,776 | 2/1969 | Lake et al. | 49/475 X |
| 3,608,265 | 9/1971 | Meunier | 52/616 |
| 3,823,524 | 7/1974 | Weinstein | 49/DIG. 1 X |
| 3,832,254 | 8/1974 | Bowser et al. | 52/616 X |

FOREIGN PATENTS OR APPLICATIONS

| | | | |
|---|---|---|---|
| 228,457 | 12/1962 | Austria | 52/616 |

*Primary Examiner*—Philip C. Kannan
*Attorney, Agent, or Firm*—Howson and Howson

[57] ABSTRACT

An insulated glass panel has a frame and spacer structure which prevents foreign matter and moisture from entering between spaced panes while affording low-cost manufacture and repair. The spacer has a pair of opposed recesses mounting beads of resiliently deformable cured elastomeric material, and the beads are compressed against the spacer by the frame which surrounds the periphery of the panes. In certain embodiments, the frame comprises a pair of frame members disposed side by side to form a hollow cavity around the periphery of the panes and snap fasteners releasably connecting the frame members together. The cavity is filled with a foam plastic material which surrounds reinforcing elements located at the corners of the frame to rigidify the frame. In one embodiment, the frame members are hinged together to permit them to pivot relative to one another between open and closed positions about an axis parallel to the edges of the panes to afford installation and replacement of the panes. In another embodiment, the frame is molded around the edges of the panes.

12 Claims, 11 Drawing Figures

INSULATED GLASS PANEL

The present invention relates to insulated panels, and more particularly, the present invention relates to panel assemblies of the type which have a pair of glass panes spaced apart with an insulating air gap therebetween.

It is known that certain heat-transfer advantages arise from the use of so-called insulated glass panels or windows in structures where substantial ambient temperature differentials exist on opposite sides of the panels. For example, this type of insulated glass panel finds particular utility when used in combination with refrigerated display cases such as those employed to contain food or beverages in markets. In a typical display case the insulated glass panels are slidable on tracks; however, the insulated glass panels may be hung on hinges. Insulated glass panels have also been utilized satisfactorily as windows and doors in buildings.

The conventional insulated glass panel is illustrated in FIG. 1 of the drawings, and as best seen therein, the panel comprises a pair of glass panes which are mounted in a frame and separated by a peripheral spacer. The panes are mounted in a recess in the inner periphery of the frame. The outer peripheral margins of the panes carry layers of a mastic sealing material, as does the spacer, to prevent moisture, dust, and other foreign matter from entering the air gap between the panes.

Although the conventional double-pane glass panel performs a satisfactory insulating function, it possesses certain limitations. For instance, the frame which receives the double panes must be accurately mitered at its corners, and this necessitates the employment of highly skilled craftsmen in order to produce a satisfactory structure. Also, it is difficult for a workman to apply the mastic neatly onto the spacer between the glass panels. Because of the skilled labor and time required, such structures are not as economical to manufacture as desired.

In the conventional panel structure, it is difficult for a workman to replace readily one or the other of the panes in the event that it should become broken after installation in a display case. This is because the mastic tends to effect a permanent bond with the glass and panel structure, rendering difficult removal of broken glass particles. Accordingly, it is expensive to replace broken panes.

With the foregoing in mind, it is a primary object of the present invention to provide a novel spacer structure for use in a double-pane insulated glass panel assembly.

Another object of the present invention is to provide an improved spacer structure which provides an effective dust and moistureproof seal for a double panel window while affording relatively simple removal and replacement of one or both of the panels in the event of breakage.

It is another object of the present invention to provide an improved insulated glass panel structure which is economical to manufacture.

As a further object, the present invention provides a unique insulated glass panel structure which may be fabricated economically by workmen possessing a minimum of special skills.

It is a still further object of the present invention to provide a simple method for assembling an insulated glass panel structure.

These and other objects, features and advantages of the present invention should become apparent from the following description when taken in conjunction with the accompanying drawings in which.

Figure 1:
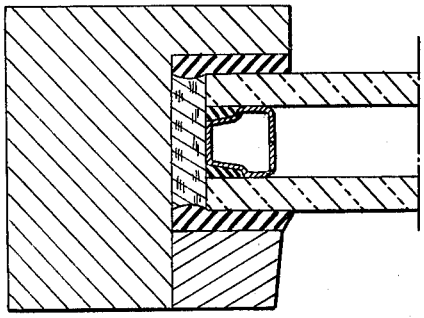
FIG. 1. (PRIOR ART)
FIG. 1 is a sectional view of a conventional insulated glass panel structure, the section being taken in a plane transverse to the plane of the glass.
Figure 2:
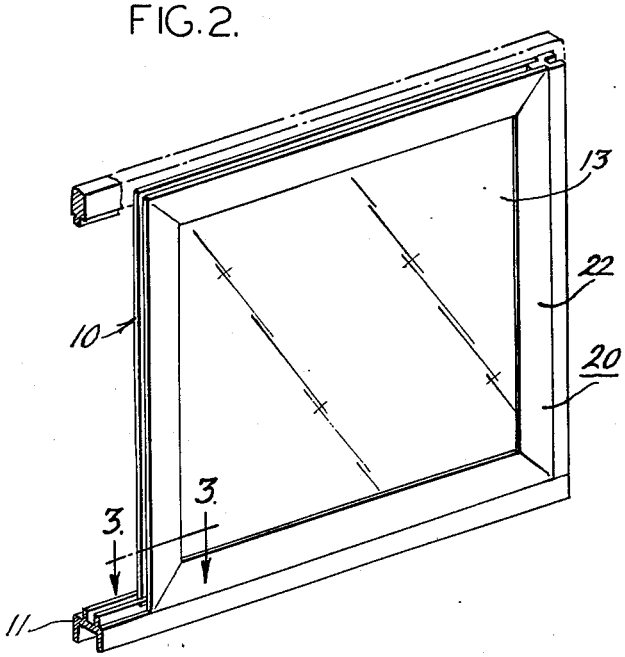
FIG. 2 is a perspective view of a sliding glass panel which embodies the novel structure of the present invention.
Figure 3:
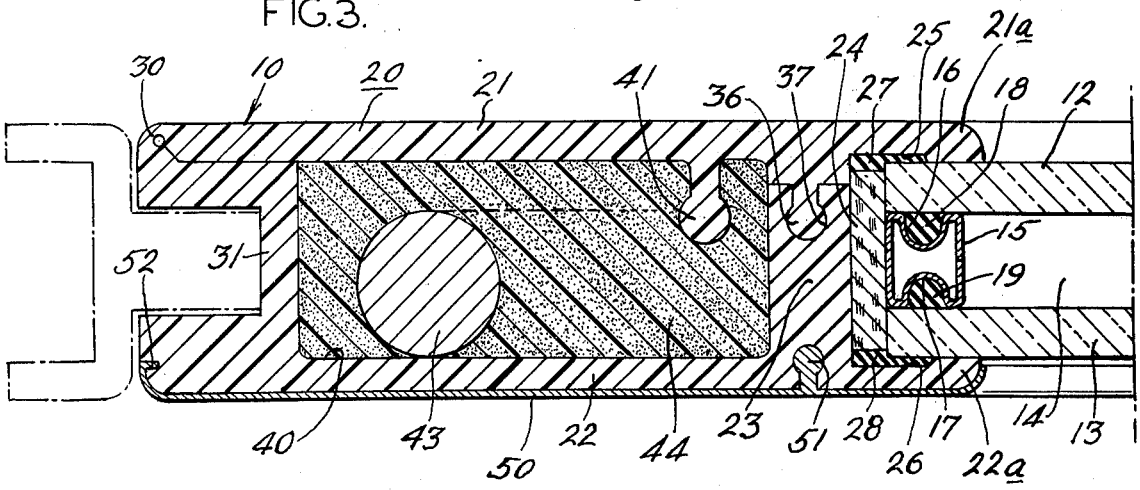
FIG. 3 is a greatly enlarged sectional view taken along line 3—3 of FIG. 2.

Referring now to the drawings, there is illustrated in FIG. 2 an insulated glass panel 10 which embodies the present invention. The panel 10 is illustrated in combination with a track 11 such as in a display case to permit the panel 10 to slide in opposite directions to afford access to the interior of the display case. As best seen in FIG. 3, the panel structure 10 comprises a pair of glass panels 12 and 13 which are juxtaposed with an insulating air gap 14 therebetween. The panels 12 and 13 are spaced apart by a spacer 15 which is disposed between the panels along their inner peripheral margins, and a frame 20 surrounds the outer peripheries of the panels.

According to the present invention, the spacer is designed to cooperate with the frame to afford economical manufacture of the panel assembly and/or replacement of one or the other of the panels in the event of breakage. To this end, the spacer 15 has a pair of opposed recesses 16 and 17 which confront the inner peripheral margins of the panels 12 and 13, respectively, and the recesses mount resilient beads or gaskets 18 and 19, respectively, which project slightly beyond the spacer. The frame 20 is designed to compress the panels against the beads 18 and 19 to provide a highly effective peripheral seal for the panel assembly. In the present instance, the beads 18 and 19 are fabricated of a cured elastomeric material, such as synthetic rubber, having a hardness preferably in a range of 30–40 durometer. The gasket material may be a cured butyl, neoprene, or silicone rubber, or it may be polysulfide cured and hardened to the above durometer range. The exemplefied gasket materials are resistant to degradation by light and resistant to penetration by water vapor.

In the present invention, the beads 18 and 19 are retained by friction in the spacer recesses 12 and 13 to facilitate assembly of the panel structure. For this purpose, each bead has a predetermined transverse dimension, and each spacer recess has a similar dimension which is slightly smaller at the entrance of the recess than the bead dimension. In the illustrated embodiment, the beads have circular cross-sections, and the entrance of the recess engages the bead outwardly of its center. In other words, the recess surrounds at least 180° of the surface of the bead. Thus, the beads may be forced into the recesses and held in place.

Figure 11:
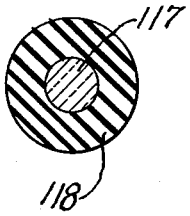
FIG. 11 is an enlarged transverse cross-sectional view of a modified gasket which may be utilized satisfactorily in the structure of the present invention.

In placing the beads in the recesses, it is important for the beads to be relatively inelastic in the longitudinal direction. To this end, a bead 118 may be provided with a relatively inelastic longitudinal reinforcing element, such as a fiberglass cord 117, as illustrated in FIG. 11, as by drawing the cord lengthwise through a circular die and simultaneously supplying a catalyzed quantity of the rubber to one side of the die during drawing. Longitudinal inelasticity is an important characteristic of the bead structure. This is because the bead should project uniformly along its length away from the spacer in order to ensure adequate pressure along the inner panel margins to effect the desired seal. If the bead were too elastic longitudinally, it would be difficult for a workman to place a length of the bead in the recess while maintaining the desired dimensional uniformity from one end of the bead to the other, considering the relatively large peripheral dimensions of most panel assemblies. Although this could be achieved without longitudinal reinforcement, the amount of labor required to install a longitudinally elastic bead would be excessive.

In order to facilitate assembly and to preserve the insulating characteristic of the panel when assembled, the frame 20 is of one-piece extruded-plastic construction, preferably polypropylene which renders it non-conductive of heat and/or electricity. In the embodiment of FIG. 3, the frame 20 includes an upper frame member 21 and a lower frame member 22 spaced therefrom. The lower frame member 22 has an upwardly extending web portion 23 which is located adjacent the edges of the glass panels 12 and 13, The frame members 21 and 22 have inward extensions 21*a* and 22*a*, respectively, which extensions have recesses 25 and 26 located adjacent the edges of the glass panes 12 and 13 for receiving sealing strips 27 and 28 of a flexible vinyl or a cured rubber material of the type of which the gasket beads 18 and 19 are fabricated. A spacer 24 of cork or other resilient non-conductive material is disposed between the edges of the panels 12 and 13 and the inner web 23 to permit the panels to expand and contract in response to changes in the ambient temperature. The inward extensions 21*a* and 22*a* of the upper and lower frame members 21 and 22 engage the outer peripheral margins of the panels 12 and 13 for compressing the beads 18 and 19 against the inner peripheral margins. With this structure, the compressed beads 18 and 19 cooperate with the cork spacer 24 and the sealing strips 27 and 28 to provide a peripheral seal which resists penetration of the air gap 14 by dust and moisture, so that the insides of the panels 12 and 13 remain moisture free and clean even in environments where high moisture and dust conditions prevail. Since the beads 18 and 19 are resiliently deformable they provide a cushion between the panels and the spacer, and since neither they nor the sealing strips adhere permanently to the glass, removal and replacement of one or the other of the panels may be effected expeditiously.

Figure 9:
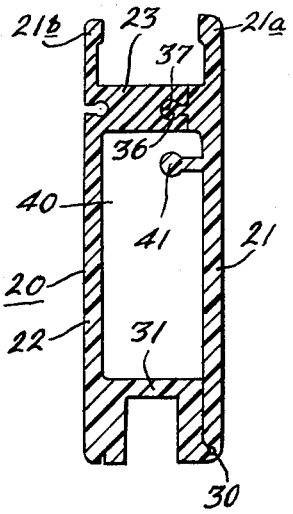
FIG. 9 is an enlarged sectional view taken along line 9—9 of FIG. 8 to illustrate the position of the frame members during mitering.
Figure 10:
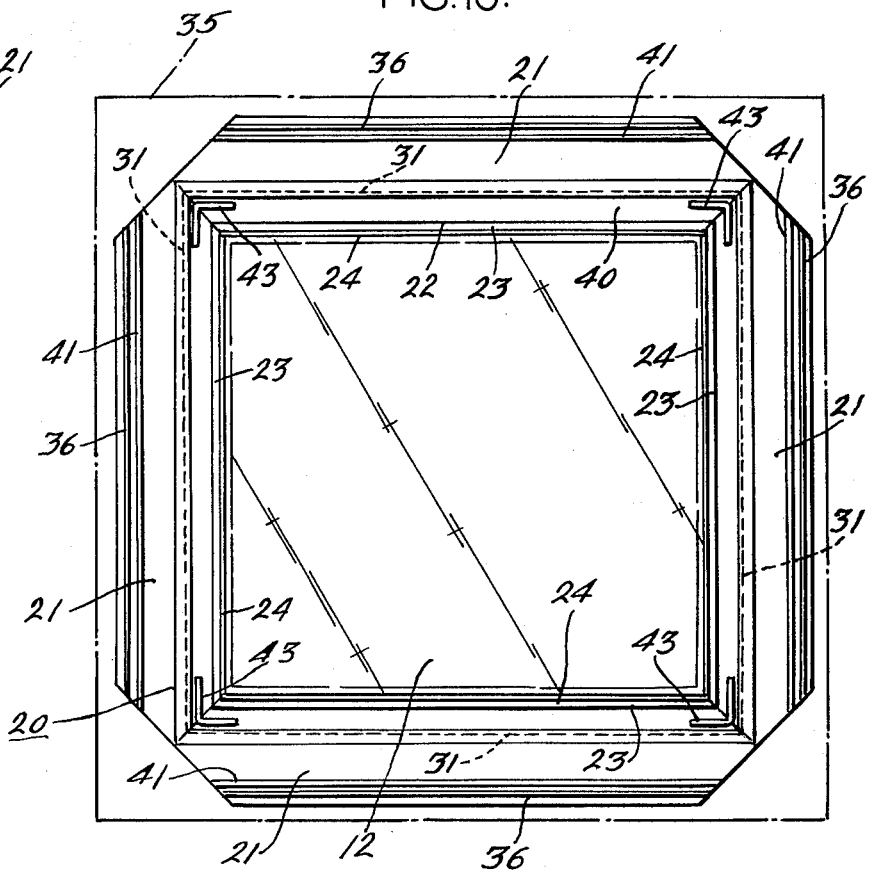
FIG. 10 is a plan view of an insulated panel in one stage of the manufacturing process.

The glass panel 10 of the present invention is economical to manufacture by workmen having a minimum of special skills. To this end, the frame 20 is fabricated from a single length of plastic material, and the upper frame member 21 is hinged to the lower frame member 22 by a thin web 30. In the present instance the web 30 is integral with the upper frame member 21 and an outer web 31 which projects upwardly from the lower frame member 22. The web connection permits the frame members to pivot relative to one another about an axis parallel to the edges of the glass panes between a closed position illustrated in section in FIGS. 3 and 9 and an open position illustrated in plan in FIG. 10. This structure enables the frame to be temporarily mounted in a jig 35 (FIG. 10) during assembly of the panes and sealing spacer.

Figure 8:
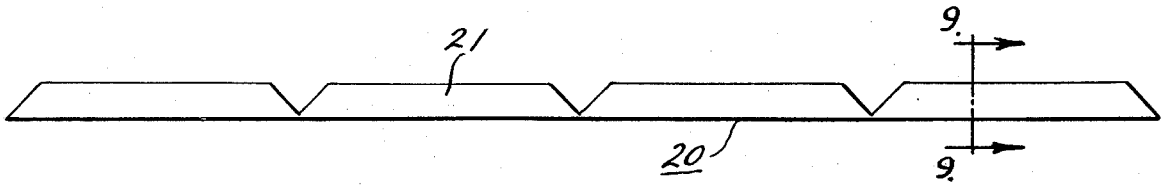
FIG. 8 is a plan view of a one-piece extruded frame prior to assembly, the frame having been mitered at spaced locations for disposition around the periphery of the panels.

The upper and lower frame members are releasably secured together during mitering of the frame 20 prior to insertion in the jig 35. For this purpose, mating complementary fastening elements are provided on the inner web 23 and the upper frame member 21. In the embodiment of FIG. 3, the mating elements include an elongated latching bead 36 which depends from the upper frame member 21 and a similarly-elongated recess 37 located in the upper edge of the inner web 23. The latching bead 36 is necked-down adjacent the upper frame member 21, and the inner web 23 is sufficiently flexible as to permit the latching bead 36 to enter the recess 37 when the upper frame member 21 is forced downwardly toward the lower frame member 22 while affording disengagement when the upper frame member 21 is pulled upwardly. This releasable connection permits the frame members 21 and 22 to be disposed in the closed configuration illustrated in FIG. 9 for accurate mitering at spaced locations such as illustrated in FIG. 8. It is noted that in the mitering operation, the frame 20 is not completely cut, so that a thin web of material remains along the outer periphery of the frame 20 to permit it to be disposed in a rectangular configuration.

The glass panel 10 is strong but affords ready removal and replacement of one or the other of the panes in the event that it should become broken. To this end, the upper and lower frame member 21 and 22 cooperate with the inner and outer webs 23 and 31 to define a cavity 40. A tongue 41 depends into the cavity 40 from the upper frame member 21, and the cavity 40 contains a foamed plastic filler material 44 which surrounds the tongue 41 and which forms a recess after it sets. The filler is preferably a high density polyurethane foam which permits the tongue 41 to be disengaged from the filler 44 when the upper frame member is pivoted relative to the lower frame member for instance to effect replacement of a broken pane. It is noted that the tongue 41 terminates in an enlargement, and the tongue and/or the filler material 44 is sufficiently flexible as to permit engagement and disengagement of the tongue 41 from the filler material.

Figure 6:
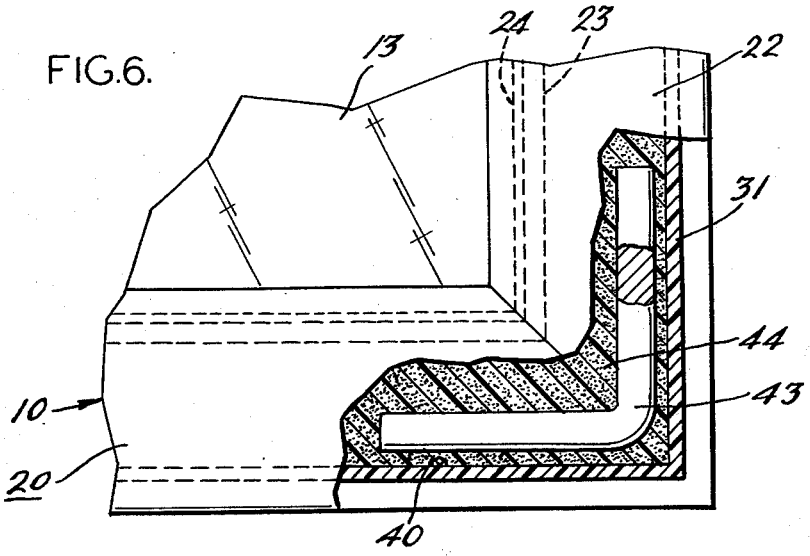
FIG. 6 is a greatly enlarged fragmentary view of the lower right hand corner of the frame illustrated in FIG. 2 with a portion of the frame being broken away to illustrate an L-shaped reinforcing element mounted in a cavity within the frame.

The frame is reinforced by steel angle elements 43 which are contained in the cavity 40 and located at the corners of the frame such as indicated in FIG. 6. After the foam 44 solidifies, the angle elements tend to rigidify the frame 20. It is noted that the foam adheres to the angle elements 43 but does not adhere to the tongue 41 by virtue of the characteristics of the materials.

In assembling the panel structure of the present invention, the mitered frame 20 of FIG. 8 is disposed in the form of a rectangle and is mounted in a similarly-shaped recess in the jig 35. The lower frame member 22 is preferably securely fastened in the jig. 35 by a vacuum-clamping assembly, and the upper frame 21 is unsnapped from the lower frame member 22, for example, by a vacuum-clamping tool which is capable of being releasably fastened to the upper surface of the upper frame member 21. The upper frame member 21 is laid open against the jig. 35 in the manner illustrated in FIG. 10. The sealing strip 28 is then installed in the recess 26 in the lower frame member 22, and the lower glass panel 13 is laid in the frame with its peripheral edge engaging the strip 28. The spacer 15, mounting its beads 18 and 19, is then placed on the lower glass panel 13, and the upper glass panel 12 is laid on the spacer 15. The cork spacer 24 is then inserted downwardly between the edges of the glass panels 12 and 13 and the inner web 23. The sealing strip 27 is then installed in the recess 25 in the upper frame member 21 while the upper frame member 21 is in the open position. The reinforcing elements 43 are laid in the cavity 40 adjacent the corners of the frame 20, and a layer of the foamable filler material 44 is charged into the cavity 40 to a predetermined depth. The upper frame member 21 is thereafter pivoted downwardly and snapped together with the lower frame member 22. The foamable material 44 is then permitted to expand to fill the cavity 40 and to surround the reinforcing elements 43 and the tongue 41 of the upper frame member 21. Thereafter, the complete panel assembly is removed from the jig. 35.

In the embodiment illustrated in FIG. 3, a decorative facing element 50 of extruded metal such as stainless steel is releasably fastened to the outside of the lower frame member 22. Preferably, the facing element 50 has a protrusion 51 which engages in a mating groove in the inner web 23 of the lower frame member 22. The facing element 50 is also provided with an inturned portion 52 which engages in a slot located in the outer periphery of the lower frame member 22 and disposed transversely to the groove which receives the protrusion 51. With this structure, the facing element 50 may be rapidly snapped into the frame 20 to provide any desired decorative effect.

Figure 4:
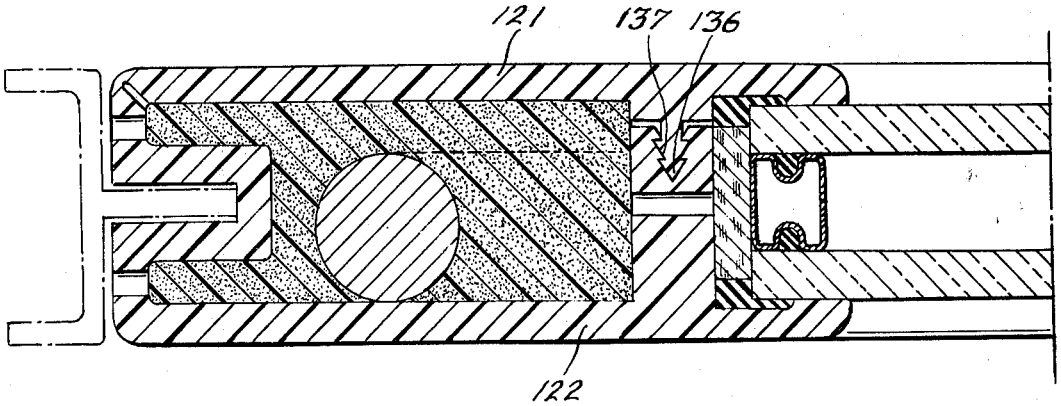
FIG. 4 is a view similar to FIG. 3 but of a modified embodiment of the present invention.

The embodiment illustrated in FIG. 4 is substantially the same as the embodiment of FIG. 3 except that a different form of snap fastener is provided for releasably connecting the upper frame member 121 with the lower frame member 122. In the embodiment of FIG. 4, a depending bead 136 has a pair of arrow-shaped heads in tandem, and a recess 137 in the inner web is similarly shaped for matingly receiving the bead 136. This structure provides a releasable connection which is sufficiently strong as not to require an additional connection, such as provided by the tongue 41 in the embodiment of FIG. 3, to provide adequate fastening.

Figure 5:
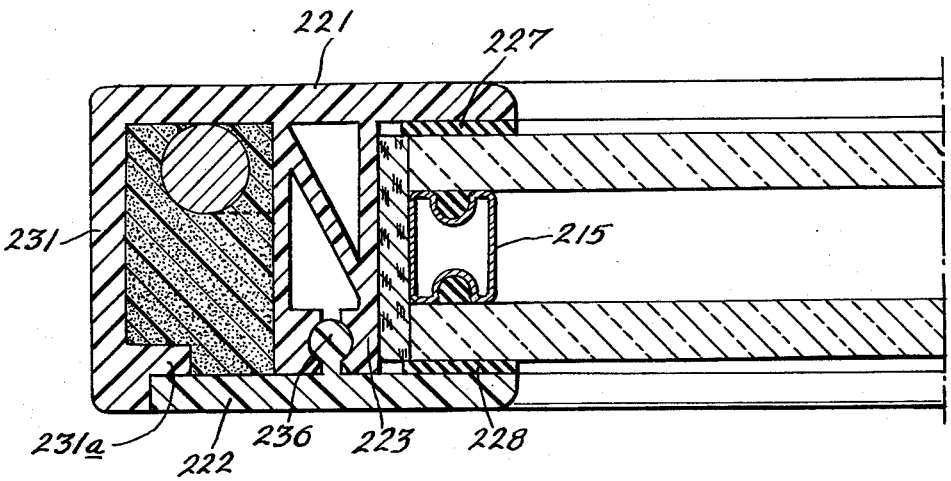
FIG. 5 is a view similar to FIGS. 3 and 4 but of another modified embodiment of the present invention.

Another modified embodiment of the present invention is illustrated in FIG. 5. In this embodiment, upper and lower frame members 221 and 222 are releasably fastened together but they are not hinged as to pivot relative to one another. Rather, the frame members are completely separable from one another. To this end, the inner web 223 depends from the upper frame member 221 and matingly receives a bead 236 which projects upwardly from the lower frame member 222. An outer web 231 on the upper frame member 221 has an inwardly-extending ledge 231*a* which engages the outer margin of the lower frame member 222 when its bead 236 is snapped into engagement with the inner web 223. It is noted that in this embodiment, the spacer 215 has a structure substantially similar to the structure illustrated in the embodiment of FIG. 4, however, in the embodiment of FIG. 5, sealing strips 227 and 228 are not contained in recesses in the upper and lower frame members. Rather, the strips are interposed between the frame members and the outer peripheral margins of the glass panes to provide a sealed zone of greater marginal width than provided in the aforementioned embodiments.

Figure 7:
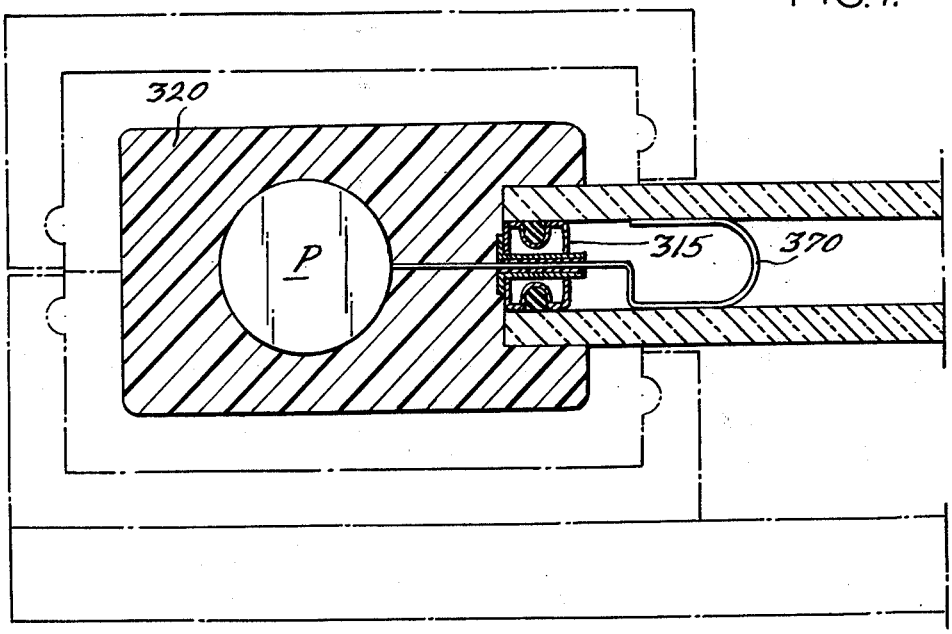
FIG. 7 is a sectional view of still another modified embodiment of the present invention wherein the frame is molded around the periphery of the glass panels and wherein means is provided to heat one of the panels.

Still another embodiment of the present invention is illustrated in FIG. 7. This embodiment is particularly suited for use in display cases wherein it is desirable for the glass panel structure to be heated to prevent condensation on the surface thereof. To this end, the frame 320 is of molded plastic construction and has a spacer 315 engaged between the glass panels. A layer of electrical resistance material is applied on the inside of the panel of glass to be heated, and electrical energy is supplied by a contact 370 which extends through the spacer 315. The contact 370 is connected to a source of electrical energy through a potentiometer P which is pre-set to supply a controlled amount of current to the resistive layer on the glass. In this embodiment, the seal 315 is compressed between the glass panes by the action of the molds (indicated in broken lines) during the molding operation and is maintained so compressed after the frame 320 sets and is removed from the molds. Although this structure provides a highly effective dust and moisture proof seal and manufacturing economies, it does not afford ready removal and replacement of one or the other of the glass panes in the event that it should become broken.

In view of the foregoing, it should be apparent that an improved peripheral seal and frame assembly has been provided for an insulated glass panel. The frame is designed to permit the panel to be manufactured economically with a minimum of skilled labor. In certain of the preferred embodiments, ready removal and replacement of the glass panes is afforded by virtue of the novel spacer structure and the snap-together construction of the frame.

While preferred embodiments of the present invention have been described in detail, various modifications, alterations and changes may be made without departing from the spirit and scope of the present invention as defined in the appended claims.

I claim:

1. An insulated panel structure comprising: a pair of panels juxtaposed to define an air gap therebetween, a spacer disposed in said gap between inner peripheral margins of said panels, said spacer having at least a pair of opposed recesses confronting said inner margins of said panels, a resiliently deformable gasket disposed in each of said recesses and having a portion extending outwardly thereof to engage said inner margins, and frame means surrounding said panels and engaging outer peripheral margins of said panels for urging said panels toward one another to compress said gasket thereagainst, said frame means including a first frame member disposed on one side of said pair of panels and a second frame member disposed on the other side thereof, one of said frame members having an inner web portion extending along the peripheral edges of said panels, an outer web on said one member spaced from said inner web, said inner and outer webs spacing said frame members apart to define therebetween a cavity, a foam material contained in said cavity, and means providing complementary mating snap fasteners releasably fastening said inner web to the other of said members.

2. An insulated panel structure according to claim 1 wherein said frame members intersect one another to form corners, and including angle elements mounted in said cavity and extending around said corners, said angle elements being spaced from said webs and surrounded by said foam material.

3. An insulated panel structure according to claim 1 including hinge means on said outer web for connecting said first and second frame members to permit the same to pivot relative to one another about axes parallel with the edges of the panels.

4. An insulated panel structure comprising: a pair of panels juxtaposed to define an air gap therebetween, spacer means interposed between inner peripheral margins of said panels to space said panels apart, frame means surrounding peripheral edges of said panels, said frame means including first and second frame members disposed alongside outer peripheral margins of said panels, means providing a hinged connection between said frame members to permit said frame members to pivot about axes parallel to said peripheral edges, and means located intermediate said hinge means and the edges of said panels for releasably fastening said frame members together, said releasable fastening means including means separating said frame members to define a cavity therebetween, one of said frame members having a tongue with an enlarged end portion extending into said cavity, and a filler material contained in said cavity and surrounding said tongue to releasably embed said tongue therein.

5. An insulated panel structure according to claim 4 wherein said frame members have laterally-inturned portions engaging said panel margins, and including sealing means disposed between said inturned portions and said inner web means.

6. An insulated panel structure according to claim 4 including inner web means disposed between said frame members adjacent the peripheral edges of said panels, said releasable fastening means including complementary mating elements on said inner web mens and said other frame member.

7. An insulating panel structure according to claim 6 wherein said mating elements include a bead on said other frame member and recess in said inner web for receiving said bead.

8. An insulated panel structure according to claim 4 including a separate facing element disposed along a side of one of said frame members and means releasably fastening said facing element to said one frame member.

9. An insulated panel structure according to claim 8 wherein said facing element fastening means includes a groove in said side and a slot disposed transversely to said groove and spaced therefrom, said facing element having an inturned portion engaging in said slot and a protrusion matingly engaging in said groove to effect said releasably fastening.

10. An insulated panel structure according to claim 4 wherein said frame members are of a preselected insulating material and said filler material is of another preselected material which is foamable and which does not adhere to said frame member material, whereby said tongue is releasably held by said foamable material.

11. An insulated panel structure according to claim 10 wherein said frame members intersect to form corners, and including a reinforcing element mounted in said cavity and extending around each corner, said reinforcing element being of a material which adheres to said filler material.

12. An insulated panel structure according to claim 11 wherein said filler material is high density polyurethane foam and said frame member material is polypropylene.

* * * * *